United States Patent [19]

Coy

[11] Patent Number: 4,782,975

[45] Date of Patent: Nov. 8, 1988

[54] VALVED CONTAINER CLOSURE

[76] Inventor: Peter Coy, 2677 South Ave., Box 229, Bryn Athyn, Pa. 19009

[21] Appl. No.: 152,537

[22] Filed: Feb. 5, 1988

[51] Int. Cl.[4] ..... A47F 19/22

[52] U.S. Cl. ..... 220/90.4

[58] Field of Search ..... 220/90.2, 90.4; 215/11.4, 11.5; 222/212, 527, 490, 213; 229/7 R

[56] References Cited

U.S. PATENT DOCUMENTS

| | | | |
|---|---|---|---|
| D. 165,778 | 1/1952 | Olsen | D36/8 |
| 2,040,545 | 5/1936 | Byers | 215/74 |
| 2,611,515 | 9/1952 | Smith | 222/213 |
| 2,622,420 | 12/1952 | Rice | 65/13 |
| 2,816,548 | 12/1957 | Tupper | 128/252 |
| 3,104,787 | 9/1963 | Thompson, Jr. | 222/490 |
| 3,165,241 | 1/1965 | Curry | 222/490 |
| 3,191,820 | 6/1965 | Kuster | 222/490 |
| 3,739,938 | 6/1973 | Paz | 220/90.4 |
| 4,121,731 | 10/1978 | Okerstrum | 220/90.4 |
| 4,133,457 | 1/1979 | Klassen | 222/212 |
| 4,239,123 | 12/1980 | Lang et al. | 220/90.6 |
| 4,345,695 | 8/1982 | Galloway et al. | 220/254 |
| 4,350,260 | 9/1982 | Prueher | 220/254 |
| 4,428,498 | 1/1984 | Obey | 220/90.4 |
| 4,596,341 | 6/1986 | Bruffey | 220/90.4 |
| 4,714,173 | 12/1987 | Ruiz | 220/90.4 |

*Primary Examiner*—George T. Hall

*Attorney, Agent, or Firm*—Volpe and Koenig

[57] ABSTRACT

A closure for containers particularly adapted for use in dispensing liquid beverages. The closure includes a spout for delivery of the liquid beverage, and the spout is provided with a flow control valve housed within the spout. The valve and spout are formed of resilient materials, and the valve is normally closed, but is openable by lip pressure applied externally of the spout.

12 Claims, 2 Drawing Sheets

VALVED CONTAINER CLOSURE

BACKGROUND AND STATEMENT OF OBJECTS

This invention relates to a closure for a container and is particularly concerned with containers as employed in the so-called fast food industries. Containers of this type are commonly provided with a cup or body and a closure lid. In some arrangements, it is contemplated to remove and discard the lid when access is desired to the food or other material to be supplied in the container. In some instances, a container lid is employed having a deflectable or removable area adapted to be used either directly for drinking or adapted to be opened for insertion of a drinking straw.

In general, prior art arrangements of the kind referred to are not adapted to be reclosed or resealed after they have been opened for use; and in consequence, in the absence of exercise of special handling care, the liquid or material in the container is subject to being inadvertently spilled after the original closure is deflected or disturbed.

It is a major objective of the present invention to provide a closure for a container, particularly adapted to handle liquids, and in which a drinking spout is provided, the drinking spout not only having an aperture for withdrawal of the contained liquid, but also having a valve therein adapted to close when the liquid is not being withdrawn through the spout.

It is a further object of the present invention to provide an arrangement of the kind above referred to in which the valve in the spout is operable by engagement of the lips of the user with the exterior of the spout, thereby providing for automatic opening of the spout when the user desires to withdraw liquid from the container through the spout, and also providing for automatic closing of the valve in the spout when the lips of the user are again separated from the spout.

In addition to the foregoing, it is a further objective of the invention to provide an initial closure tab associated with the spout in relation to the valve so that for purposes of shipment and handling, the closed container will remain substantially sealed until the closure tab is intentionally removed.

BRIEF DESCRIPTION OF THE DRAWINGS

How the foregoing objects and advantages are attained will appear more fully in the following description of the drawings, in which.

Figure 1:
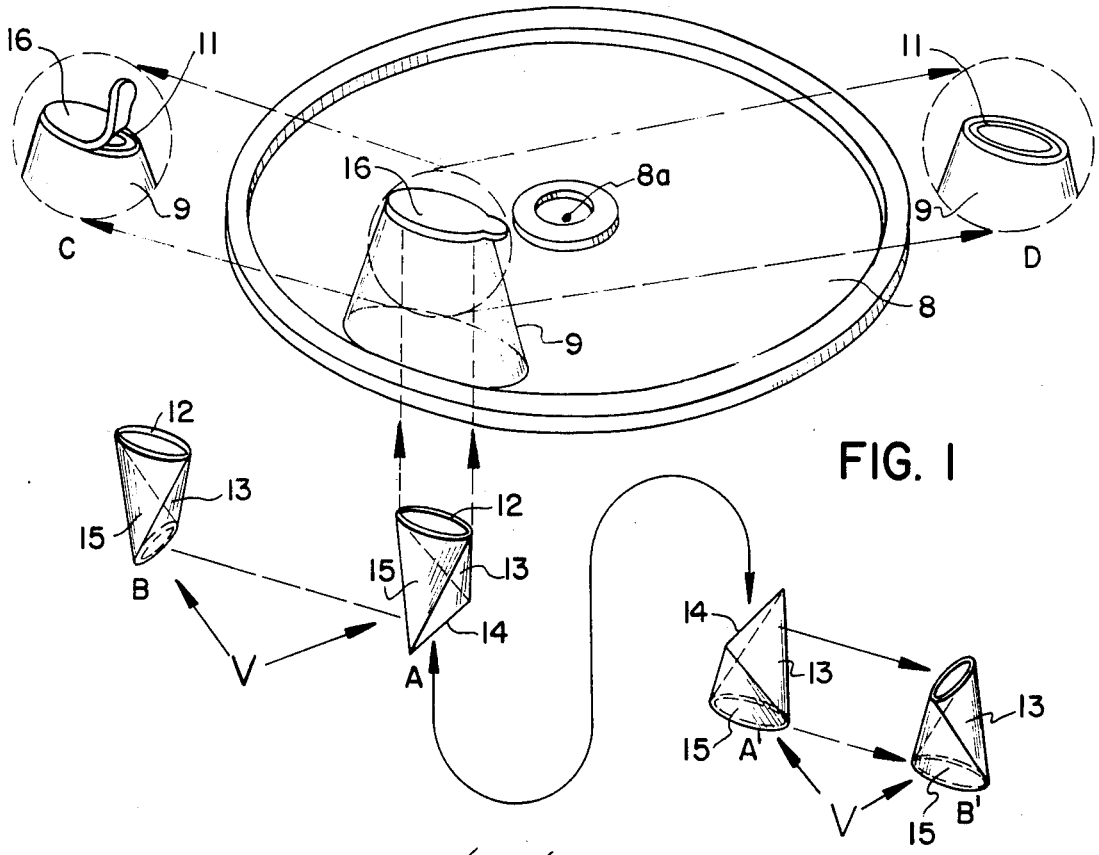
FIG. 1 is an overall perspective view of a lid or closure or container according to the present invention, the lid having a spout adapted to surround or house a control valve, the valve being illustrated in FIG. 1 in separated relation to the lid in several positions below the illustration of the lid itself, as will be explained more fully hereinafter.
Figure 2:
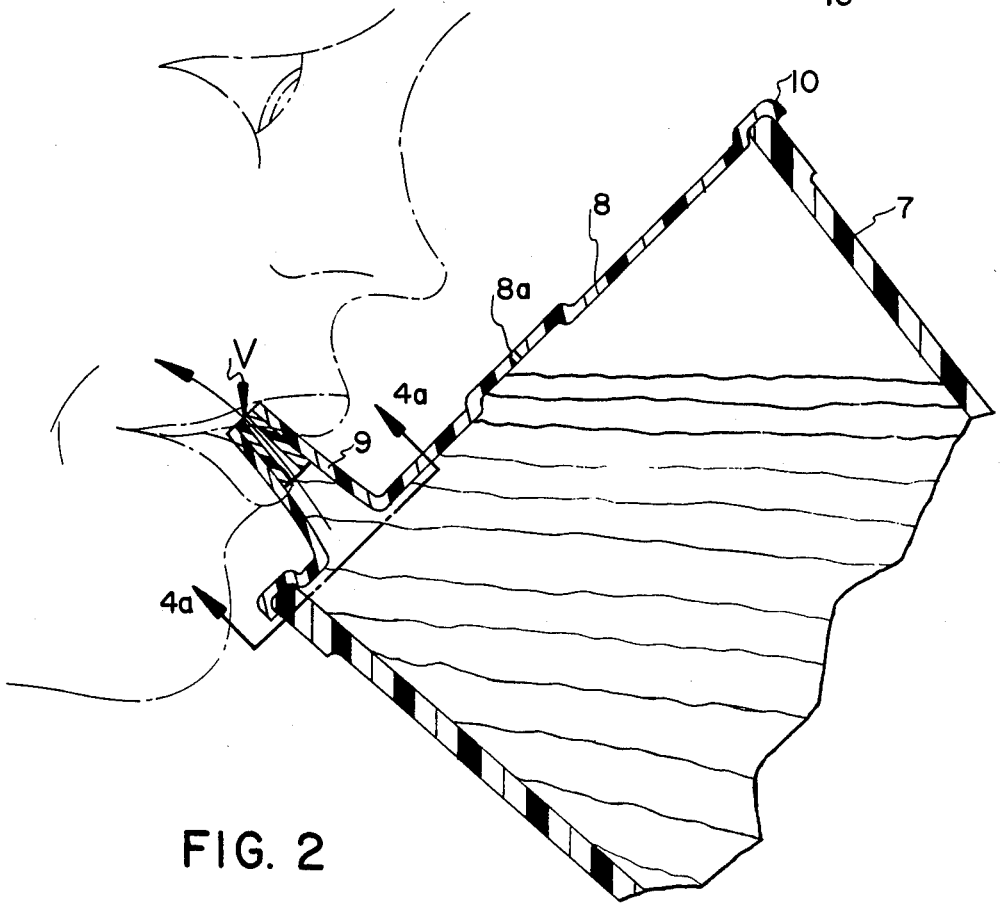
FIG. 2 is a fragmentary sectional view of the upper portion of a cup having a closure or lid according to the present invention, including the spout and the interior valve, this figure showing the valve in opened position, as a result of engagement of the lips of a user.
Figure 3:
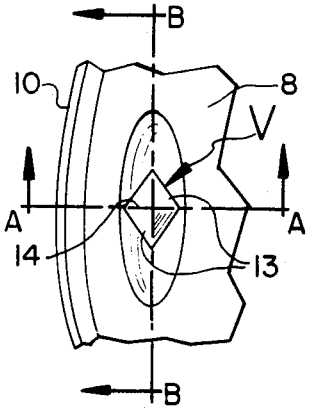
FIG. 3 is a fragmentary view taken as indicated by the section line 3—3 applied to FIG. 2, but showing the parts disengaged from a user and with the interior valve in closed position.
Figure 3A:
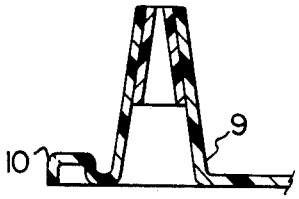
FIGS. 3A and 3B are sectional views taken as indicated by the sections lines A—A and B—B applied to FIG. 3.
Figure 3B:
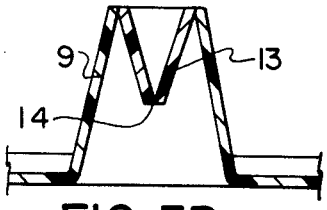
Figure 4:
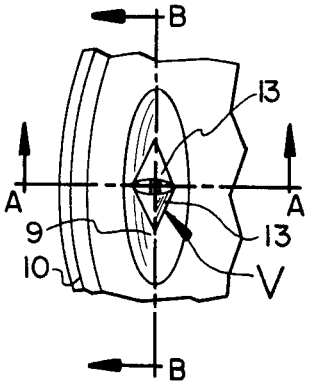
FIG. 4 is a view similar to FIG. 3 taken as indicated by the section line 3—3 applied to FIG. 2, but FIG. 4 shows the valve in opened condition.
Figure 4A:
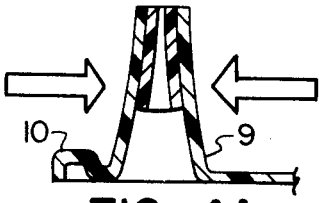
FIGS. 4A and 4B are sectional views taken as indicated by the section lines A—A and B—B applied to FIG. 4, these sectional views also showing the valve in opened condition.
Figure 4B:
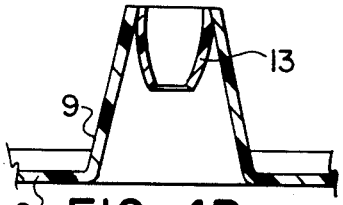

DETAILED DESCRIPTION OF THE DRAWINGS:

Referring first to FIGS. 1 and 2, the container is indicated by the reference numeral 7, and the lid for the container is indicated at 8. The container may be formed of any desired material, quite commonly a sheet plastic or molded foamed plastic or paper or cardboard; and the lid may also similarly be formed of materials of the same type. In embodiments such as herein illustrated, in which the spout 9 is integrally molded or formed with the remainder of the lid 8, it is preferred that the material employed have the characteristics of sheet material having substantial flexibility and resiliency so that the spout may readily be compressed by the lips of the user, for the purposes fully described herebelow. As is customary with lids of the kind referred to for containers of the kind referred to, the lid ordinarily has a peripheral groove or socket 10 adapted to receive and interengage with the upper edge of the cup 7 itself.

The spout 9 is connected with the lid and the spout has a flow passage between the interior and the exterior of the cup; and preferably, this flow passage is of ovoid cross section and also of progressively reduced dimensions from the surface of the lid 8 upwardly to the delivery opening 11 (see the figure details indicated by the letters C and D associated with FIG. 1).

Although the spout 9 and the lid may be separately formed or molded and then interconnected, they may also, as is disclosed in FIGS. 1–4, be integrally molded with the remaining structure of the lid.

With the foregoing description of the general arrangement of the lid and the spout in mind, attention is now directed to the four illustrations marked A, B, A', and B', these illustrations showing the interior control valve indicated generally by the letter V. This valve is positioned within the spout 9 but is shown in exploded relation to the spout in the illustrations marked A, B, A' and B'. Certain details of the valve are also more fully disclosed in FIGS. 3, 3A, 3B, 4, 4A and 4B.

The valve is preferably formed of flexible and resilient material, for example, synthetic rubber compositions. The valve has an upwardly presented opening of ovoid shape similar to the ovoid shape of the upper or delivery opening 12 of the spout 9 and fitting just inside of the delivery opening 11 of the spout. The valve further has tapered or inclined surfaces 13—13 (see also FIGS. 3 and 4) converging downwardly and meeting at the lower edge 14 of the valve, as will clearly appear from comparison of FIGS. A and A' positioned below the main portion of FIG. 1 and also shown in FIGS. 3 and 3B. The valve in opened position is shown in FIGS. B and B' below the main portion of FIG. 1.

The detail FIGS. A and A' in the lower part of FIG. 1 shows the valve when in the closed or "at rest" position. The valve is opened by application of lip pressure, as indicated by the arrows at the sides of FIG. 4A, this lip pressure being communicated through the side walls of the spout 9, as clearly appears in FIG. 2, and transmitted through the side walls to the walls 15 of the valve V, which lie between the converging walls 13. When this occurs, the side walls 13 of the valve separate from each other in the manner clearly shown in FIGS. 4, 4A and 4B, thereby opening the valve port along the lower edge of the valve and thus provide communication from the interior of the container upwardly through the spout 9. This provides for delivery of the liquid from the container upwardly through the valve and out of the delivery opening 12 of the valve and thus also out of the delivery opening 11 of the spout 9.

When the lip pressure is again released from the side walls of the spout, the converging walls 13 of the valve again move to close the opening along the line 14 at the lower end of the converging walls 13.

The automatic closure of the valve when the lip pressure is released is not only desirable in order to avoid leakage, but when handling heated liquids, is also advantageous in reducing heat loss of the contents of the container.

The foregoing alternate opening and closing of the valve, as a result of the action of the lips of the user, will be fully apparent from comparison of FIGS. 1, 2, 3, 3A, 3B, 4, 4A and 4B.

The lid 8 is desirably provided with a very small aperture, for instance, in the central region, as indicated at 8a in FIGS. 1 and 2, thereby providing for ingress of air as the contents of the cup are being withdrawn through the valve, and thus prevent development of negative pressure within the cup during delivery of the liquid. An appropriate aperture for this purpose need only have very small cross-sectional dimension and will, therefore, not even result in leakage of the liquid under any normal handling conditions.

In the embodiment of FIGS. 1–4, see particulary the detail indicated at the letter C of FIG. 1, a separable tab 16 is initially provided in position overlying the delivery opening 11 of the spout 9, for the purpose of sealing the container for prepackaged products. This tab desirably has adhesive bonding and is readily manually removable in preparation for use of the container and the valved spout. This tab may alternately be molded or formed integrally with the spout wall, and arranged for manual separation from the body of the spout.

For effecting the feed operation above described, it is desirable that the spout 9 be formed of sheet material which has some flexibility, and preferably also some resilience so that it will return to the closed position when the lip pressure is released.

The sheet material employed for the valve used within the spout should also be flexible and resilient. This is important so that after opening of the valve by compression under the action of the lips of the user, and subsequent release of the lip engagement, the inclined valve walls 13, which meet along the lower edge 14 when the valve is closed, will return to the "closed" position. When the valve is opened by external pressure applied to the spout, the lower part of the walls 15 move toward each other so that the dimension in the direction of the line 14 is reduced and this causes opening of the valve.

The proportions of the valve itself, and also of the interior of the spout 9, are also configured so as to provide a peripheral sealing interengagement between the outer surface of the valve and the inner surface of the spout in the upper region of the spout and valve. This is important in order to avoid any tendency for leakage from the spout except when the valve is intentionally opened. In the specific embodiments as herein disclosed, it is contemplated that portions of the external surface of the valve itself such as the side walls 15 be adhesively bonded to the interior surface of the spout. With the configurations illustrated in the drawings, this is desirably effected throughout the height of the valve, i.e., throughout the height of the side walls 15. In this way, the rebound of the spout walls after separation of the lips serves to assure reclosing of the valve along the line 14.

As above indicated, the lid and the spout are desirably formed, as by molding, from sheet plastic material. The entire lid, including the spout, may be molded as a single unit or, if desired, the spout and the planar portion of the lid may be separately formed and then interconnected. In any event, the thickness of the material used in the spout should be on the order of from about 0.001" to 0.050", so that the spout may readily be compressed by forces produced by the lip engagement. Compression of the sides of the interior valve V is, of course, also required; and as above indicated, the valve material is desirably resilient, and the thickness of the material used for the valve may also lie within about the range of thickness above referred to for the spout wall.

The wall of the cup 7, on which the lid is employed, may be made of any of a wide variety of materials, one common material used for this purpose being foamed plastic. Material of this type is not only lightweight, but provides adequate strength and rigidity, as is well known.

Figure 5:
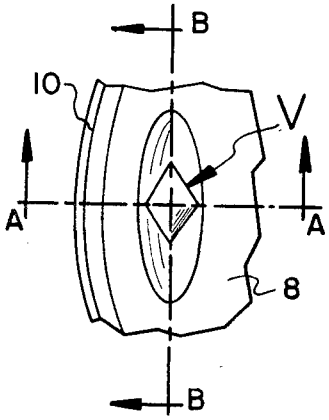
FIGS. 5, 5A and 5B are views illustrating a modification of the arrangement shown in FIGS. 1–4, FIGS. 5A and 5B being taken as indicated by the section lines A—A and B—B applied to FIG. 5 and showing the valve in closed position.
Figure 5A:
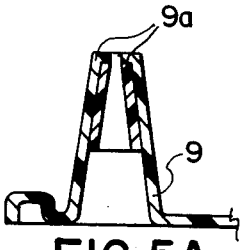
Figure 5B:
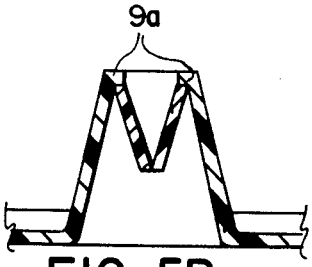

In the alternative embodiment illustrated in FIGS. 5, 5A and 5B, the arrangement of the interior valve and the general configuration of the spout are similar to those described above in connection with the first embodiment. However, in the embodiment of FIGS. 5, 5A and 5B, the upper edge of the spout 9 is provided with an interned flange 9*a* overlying the upper open end of the valve V. This provides a flange surface for interengagement with the upper edge of the open end of the valve, which may be desirable with certain materials in order to stabilize the valve in the spout.

Figure 6:
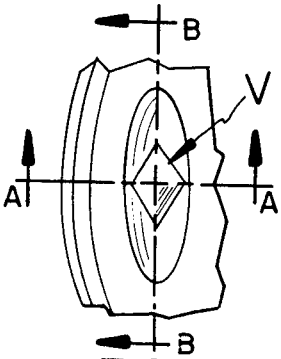
FIGS. 6, 6A and 6B are views of still another embodiment, the views again being similar to FIGS. 3, 3A and 3B, with the sectional views 6A and 6B being taken as indicated by the section lines A—A and B—B applied to FIG. 6 and showing the valve in closed position.
Figure 6A:
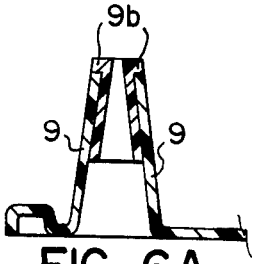
Figure 6B:
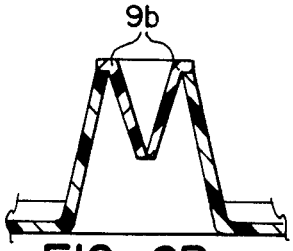

Another alternative for similar purposes is illustrated in FIGS. 6, 6A and 6B. In this embodiment, the upper edge of the valve is provided with laterally extending flanges 9*b* which overlie the upper edges of the spout 9; and this will provide a similar stabilizing action in the relation between the valve and the spout.

I claim:

1. A controllable valve device for use in dispensing a liquid from a container, said device comprising two tubular components nested one within the other and each formed of resilient sheet material, the outer one of said components being normally open at both ends and having its inlet end presented toward the container and its outlet end presented in a direction away from the container, and the inner one of said components having an outlet end normally open and presented in the same direction as the outlet end of the outer component, and the inner component having an inlet end presented in the same direction as the inlet end of the outer component, and the resilient sheet material of the inlet end portion of the inner component having planar terminal portions at opposite sides of the inner component providing a normally closed valve apex yieldingly openable by application of lateral compression to the inner component through the wall of the outer component in a direction edgewise to said planar terminal portions providing said valve apex.

2. A valve device according to claim 1 wherein the outer component is oval in cross-section and the valve apex provided by said planar terminal portions of the inner component lies in a plane transverse to the oval diameter of longest dimension.

3. A valve device according to claim 1 wherein said inner component is sealingly engaged about the perimeter of its outlet end with the outer component in the outlet end region of the outer component.

4. A valve device according to claim 1 wherein the valve apex provided by terminal portions at opposite sides of the inner component is positioned downstream from the outer component inlet end.

5. A container closure comprising a lid member, said lid member having an aperture and means for sealingly engaging the lid member with the perimeter of a container opening, a valve device extending upwardly from the lid member for selectively dispensing a liquid from a container, said valve device comprising two tubular components nested one within the other and each formed of resilient sheet material, the outer one of said components being normally open at both ends and having its inlet end presented toward the container and the perimeter of said inlet end sealingly engaged with the lid member about the lid member aperture, and the outlet end of said outer component being presented in a direction away from the container, and the inner one of said components having an outlet end normally open and presented in the same direction as the outlet end of the outer component, and the inner component having an inlet end presented in the same direction as the inlet end of the outer component, and the resilient sheet material of the inlet end portion of the inner component having planar terminal portions at opposite sides of the inner component providing a normally closed valve apex yieldingly openable by application of lateral compression to the inner component through the wall of the outer component in a direction edgewise to said planar terminal portions providing said valve apex.

6. A container closure according to claim 5 wherein the perimeter dimension of the inlet end of said outer component is less than the perimeter dimension of the lid member and said inlet end perimeter being sealingly engaged about the perimeter of said lid member aperture and positioned adjacent one edge of the lid member.

7. A spill-resistant beverage-dispensing container comprising an upwardly open container, a lid member sealingly engaged with and covering the opening of said container, and a lip-controllable valve device for selectively dispensing a liquid from the container, the valve device comprising two tubular components nested one within the other and each formed of resilient sheet material, the outer one of said components being normally open at both ends and having its inlet end presented toward and communicating through an aperture in the lid member with the interior of the container, the inlet end being sealingly engaged about its perimeter with the perimeter of the lid member aperture, and its outlet end presented in a direction away from the container, and the inner one of said components having an outlet end normally open and sealingly engaged with the outer component in the region of the outer component outlet end, and the inner component having an inlet end presented toward the inlet end of the outer component, and the resilient sheet material of the inlet portion of the inner component having planar terminal portions at opposite sides of the inner component providing a normally closed valve apex yieldingly openable by application lateral compression to the inner component through the wall of the outer component by a user's lips in a direction edgewise to said planar terminal portions providing said valve apex.

8. The container according to claim 7 wherein the perimeter dimension of the outlet end of said outer component is less than the perimeter dimension of the lid member and said inlet end perimeter being sealingly engaged about the perimeter of said lid member aperture and positioned adjacent an edge of the lid member.

9. The container according to claim 7 wherein the valve apex provided by terminal portions at opposite sides of the inner component is positioned downstream from the outer component inlet end.

10. A closure device for a container for a drinkable liquid, the closure device comprising a lid member, said lid member having an aperture and means for sealingly engaging the lid member with the perimeter of a container opening, a valve device controllable by the lips of the user, the valve device extending upwardly from the lid member and providing for selectively dispensing the liquid from the container, said valve device comprising a tubular component having openings at both ends and having an inlet end presented toward the container with the perimeter of said inlet end sealingly engaged with the lid member about the lid member aperture, the outlet end of said tubular component being presented in a direction away from the container, a valve member in said tubular component between the inlet and outlet ends of said tubular component, said valve being openable and closeable by engagement and disengagement of the lips of the user, and a sealing tab adapted to overly and seal the outlet end of said tubular component, said sealing tab being manually displaceable to open the outlet end of the tubular component.

11. A controllable valve device for use in dispensing a liquid from a container, said device comprising two tubular components nested one within the other and each formed of resilient sheet material, the outer one of said components being normally open at both ends and having its inlet end presented toward the container and its outlet end presented in a direction away from the container, and the inner one of said components having an outlet end normally open and presented in the same direction as the outlet end of the outer component, and the inner component having its outer wall in circumferential engagement with the inner wall of the outer component and having an inlet end presented in the same direction as the inlet end of the outer component, and the resilient sheet material of the inner component having surfaces providing a normally closed valve yieldingly openable by application of lateral compression to the inner component through the wall of the outer component.

12. A container for a liquid, the container having an enclosure wall with a liquid delivery aperture, a drinking spout connected with said wall, the spout having a wall formed of resilient sheet material and having an inlet opening at one end communicating with said aperture and having an outlet end presented away from the enclosure wall, and a tubular valve member positioned in said spout, the valve member having a wall formed of resilient sheet material and having an outlet end presented in the same direction as the outlet end of the spout and having a tubular inlet end presented toward the aperture in the enclosure wall, the resilient sheet material of the inlet end of the valve having inclined planar terminal portions at opposite sides of the tubular inlet end portion of the valve providing a normally closed valve apex yieldingly openable by application of lip pressure applied laterally to the valve through the wall of the spout in a direction edgewise to said planar terminal portions providing said valve apex, the wall of the valve member between said inclined terminal portions being proportioned to lie adjacent to the inside surface of the spout and being adhesively bonded to the inside surface of the spout, thereby providing for closure of the valve apex when the lip pressure is released.

* * * * *